United States Patent [19]

Pratt, Jr.

[11] 4,087,719

[45] May 2, 1978

[54] SPARK PLUG

[75] Inventor: George W. Pratt, Jr., Wayland, Mass.

[73] Assignee: Massachusetts Institute of Technology, Cambridge, Mass.

[21] Appl. No.: 663,648

[22] Filed: Mar. 4, 1976

[51] Int. Cl.[2] ..... H01J 7/44; H01J 13/46; H01J 17/34; H01K 1/62

[52] U.S. Cl. ..... 315/45; 313/139; 313/140; 313/141; 315/59; 123/169 MG; 123/169 EL

[58] Field of Search ..... 313/138, 139, 140, 141, 313/142, 131; 315/41, 45, 59; 123/169 R, 169 MG, 169 EL

[56] References Cited

U.S. PATENT DOCUMENTS

| | | | |
|---|---|---|---|
| 1,086,327 | 2/1914 | Kopf | 315/59 |
| 1,417,876 | 1/1921 | Wood | 313/142 |
| 1,528,949 | 3/1925 | Reich | 313/140 X |
| 3,394,285 | 7/1968 | Lindsay | 313/141 X |
| 3,538,372 | 11/1970 | Terao | 313/142 X |
| 3,911,307 | 10/1975 | Goto et al. | 313/142 |
| 3,958,144 | 5/1976 | Franks | 313/138 |

FOREIGN PATENT DOCUMENTS

| | | | |
|---|---|---|---|
| 572,446 | 2/1924 | France | 313/140 |
| 640,286 | 3/1928 | France | 123/169 |

*Primary Examiner*—Saxfield Chatmon, Jr.
*Attorney, Agent, or Firm*—Arthur A. Smith, Jr.; Robert Shaw

[57] ABSTRACT

A spark plug wherein corona discharge is employed to create a long arc and to determine, in part, the path of the arc, electrodes of the spark plug being shaped, oriented and positioned to create an arc of desired length, orientation and at a desired location as well as to effect electromagnetic interaction between electric current in the arc and the current in at least one of the electrodes to provide a force on the arc which acts in consort with the electrode shapes, positions and orientations to control its spatial behavior, the electrode configuration being further selected so that ionized species in the flame of ignited fuel are subjected to a high electric field over a substantial volume.

27 Claims, 9 Drawing Figures

SPARK PLUG

The present invention relates to spark plugs employing both corona discharge and arc discharge and to systems employing the same.

Attention is called to an application for Letters Patent Ser. No. 508,381, filed Sept. 23, 1974 (Pratt, Jr.), and to the prior art presented in connection with the application by the applicant and to application Ser. No. 546,232, filed Feb. 3, 1975 (Pratt, Jr.), now U.S. Pat. No. 3,974,412.

The problem of atmospheric pollutants by combustion engines has long plagued the automobile industry; these pollutants, of course, are mainly hydrocarbons and oxides of nitrogen ($NO_X$). It has been found, for present purposes, that both pollutants can be reduced by providing an arc that is substantially longer than available using spark plugs now in use.

Accordingly, it is an object of the present invention to provide a spark plug which, in an operating system, can provide an arc at least the order of 100 mils and longer.

Another object of the invention is to control the arc of a spark plug in a way that allows some control over the path followed by the arc.

A further object is to provide a substantially long arc and one that, once initiated, can be moved about to alter the length of the same to enhance combustion in a system by virtue of the movement alone.

A still further object is to provide a spark plug wherein the trajectory of the arc is affected by electromagnetic interaction between electric current in the arc and electric current in the electrodes of the spark plug.

A still further object is to provide a spark plug whose sparking surfaces are so positioned and so shaped that electric lines of force act, in part, to establish a desired path for the arc.

A further object is to provide a spark plug wherein the role of the lines of force is to couple to the ionized species created during combustion, thereby to affect the nature of flame propagation.

Another object is to provide a spark plug wherein magnetic particulate is employed to enhance such electromagnetic interaction.

Still another object is to provide a spark plug wherein the electrodes and/or insulating parts employ low work function materials to promote corona and arc discharge.

Still another object is to provide a spark plug that acts to generate active chemical species in the corona discharge and secondary charged species in the arc discharge to facilitate and enhance combustion.

These and still further objects are elaborated upon in the description that follows.

The foregoing objects are achieved in a spark plug having two main electrodes with a first sparking surface and a second sparking surface, respectively, and an intermediate or floating electrode between the two and capacitively coupled to one of the main electrodes, there being a first gap formed between the first sparking surface and the sparking surface of the floating electrode and a second gap between the sparking surface of the floating electrode and the second sparking surface. The geometries of the first sparking surface and the second sparking surface are chosen to provide a spark gap that differs at one location between the surfaces from the gas at each other location therebetween, that is, there is a variable-length gap between the sparking surfaces of the main electrodes; said geometries are further chosen to serve, together with interacting electric currents in one of the main electrodes and in the arc that appears between sparking surfaces of an operational spark plug, to guide said arc and effect spatial movement thereof. At one region thereof, the two main electrodes are separated from one another by a distance much less than the shortest length of the gap between the first sparking surface and the second sparking surface, there being a high dielectric solid insulation therebetween at said region so that, in an operating system, a corona discharge occurs at said region to initiate arcing between said sparking surfaces. The electrode configuration is further selected so that the ionized species created by the combustion process will be subjected to a high electric field for a time period following the initiation of combustion.

The invention is hereinafter described with reference to the accompanying drawing in which.

Figure 1:
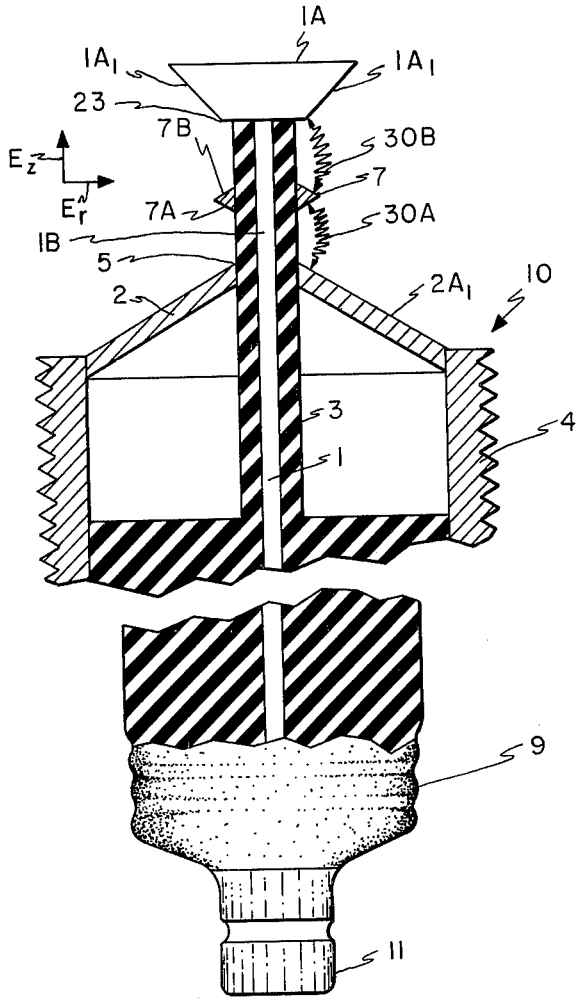
FIG. 1 is a partial elevation view, partly cutaway, showing a spark plug having main electrodes with tapered sparking surfaces and a floating electrode with tapered sparking surfaces.

Before going into a detailed explanation of the structure of the present spark plug, there follows first an overall discussion. The purpose of the ignition device herein disclosed is to create an arc discharge whose length is much longer than ordinarily obtainable and whose length and disposition can be electronically controlled. Experimental results indicate that a corona discharge is a precursor to the arc and that the corona may be used for several purposes. First it may be used to charge fuel droplets that may be present, for example, in fuel injection engines and to concentrate the charged fuel droplets so as to affect the air-to-fuel ratio to enhance the ignition and combustion process. Second, the corona will act to generate active radicals which promote the combustion process. Third, the corona can establish a path along which an arc discharge is guided or preferably established. This favorable path can be substantially longer than ordinarily obtainable. For example, it was discovered that an arc 0.125 inches long was established repeatedly in a Chrysler 360 CID engine using their standard ignition system with a complete set of plugs based on a structure like that shown in FIG. 5. The length of path of the arc was discovered to be only weakly dependent on pressure after a certain threshold voltage is attained. Tests have shown that a gap of 0.225 inches between sparking surfaces with a floating electrode midway between the two, as shown in FIG. 1, can be fired in a 360 CID Chrysler combustion engine, using standard equipment and in a wide range of operating conditions. Furthermore, by proper design of the electrode configuration and the electrodes, it is possible to control the path and consequently the length of the arc discharge. As later explained, this control is acquired in part and in appropriate circumstances, by virtue of the repulsion of two oppositely directed electric currents and in part by appropriately shaping the sparking surfaces of the plug. The duration of the corona phase of the plug firing can be controlled and may vary in time down to the submicrosecond regime. The spark plug has a number of further advantages in an operating system, as now explained.

The ignition process in a combustion engine depends on the interplay of several factors. The plug forms part of the electrical circuit of the ignition system. This circuit is characterized by resistive, inductive and capacitive elements which can be controlled to affect the magnitude and time dependence of the voltage across the plug electrodes and the current through them. In particular, voltage and current rise times, duration and alternation in polarity are of importance, as is the nature of the energy dissipation in each plug firing. Another factor is the heat transfer properties of the spark plug. By proper design, the electrodes can act to control the temperature of the initial ignited volume, which is important because during the initial period combustion tends to attain the highest temperature and to produce a large part of the $NO_X$ pollutants. By properly designing the electrodes so as to heat sink as large a volume of the initial flame as possible, as is done in the present plug, an $NO_X$ reduction can be acieved. Also, a very important factor in controlling flame propagation and the heat transfer from the flame to the plug is the nature of the electric field to which the burning air-fuel mixture is subjected by the energized spark plug. The time duration of the voltage across the plug electrodes is from one to several hundred microseconds. The flame front moves approximately 1–2 mm in 150 microseconds. During this time a considerable number of charged species are created by the combustion process itself. They are then subjected to the electric field associated with the energized plug and consequently a substantial force is exerted upon the flame. The affected combustion volume in the plug disclosed herein can be of the order of 200 $mm^3$, whereas the flame volume subjected to a high field in the conventional plug is only several $mm^3$, i.e., perhaps 1/100th that of the present plug. During the first few hundred microseconds the voltage across the plug can oscillate in polarity producing a correspondingly oscillating force on the propagating flame. The force on the flame tends to drive it into the plug electrodes where heat will be extracted. It is further apparent that in the disclosed spark plug the arc discharge combined with the electromagnetic forces acting upon the charged species associated with the combustion process will act to create turbulence in the burning fuel. A further factor in the ignition process is the creation of secondary electrons at the positive plug electrode, and, again, the large sparking surfaces and the shape and orientation thereof serve to maximize the desired effect. In the description that now follows, an attempt is made to apply the same or similar labels to system elements that perform the same of similar functions.

Figure 2:
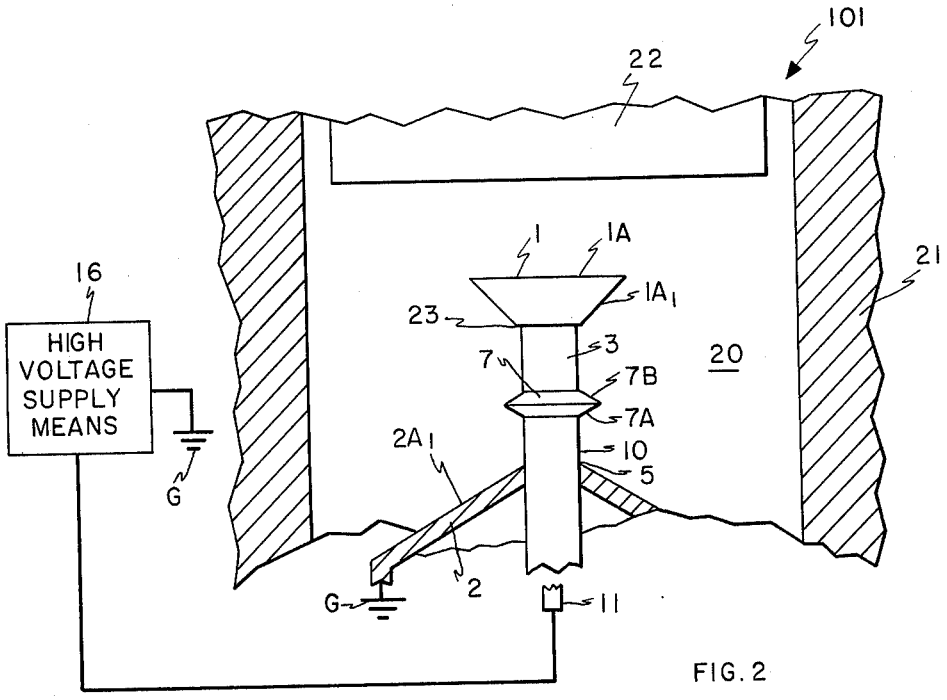
FIG. 2 is a highly diagrammatic representation showing a part of the combustion system of an automobile and including a schematic representation of a spark plug similar to the spark plug of FIG. 1.

With reference now to FIG. 2, a combustion system is shown at 101 comprising a spark plug 10 and high voltage supply means 16 interconnected and the cylinder, labeled 21, and the piston, labeled 22, of a combustion engine. As shown in FIG. 1, the spark plug 10 has a base of body 4 which, as in a conventional plug, is the threaded metal structure that threads into the engine block of any automobile. A high voltage axial or central electrode 1 extends from an input terminal 11 at a first end of the plug 10 through the plug body 4 and outward to a second end of the plug axially separated from the first end. The central electrode 1 is surrounded by an insulator 9 which isolates the electrode 1 from the conductive plug body 4. The part labeled 1B of the electrode 1 that extends outward from the base 4 is surrounded by an insulating jacket 3 that is merely an extension of the insulator 9, and the exposed end of the electrode 1 at said second end is an electrically conductive cap 1A shaped in the form of the frustum of a cone. A ground electrode 2, attached to the body 4 and also in the shape of the frustum of a cone, extends inward from the base 4 to the vicinity of the electrode 1; sparking surfaces of the electrodes 1 and 2 are labeled $1A_1$ and $2A_1$, respectively. Experimental results indicate that the electrodes 1 and 2 act in combination with the high voltage means to create, first, a corona discharge and, then, an arc discharge through the corona, as now discussed with reference to FIG. 5.

Figure 5:
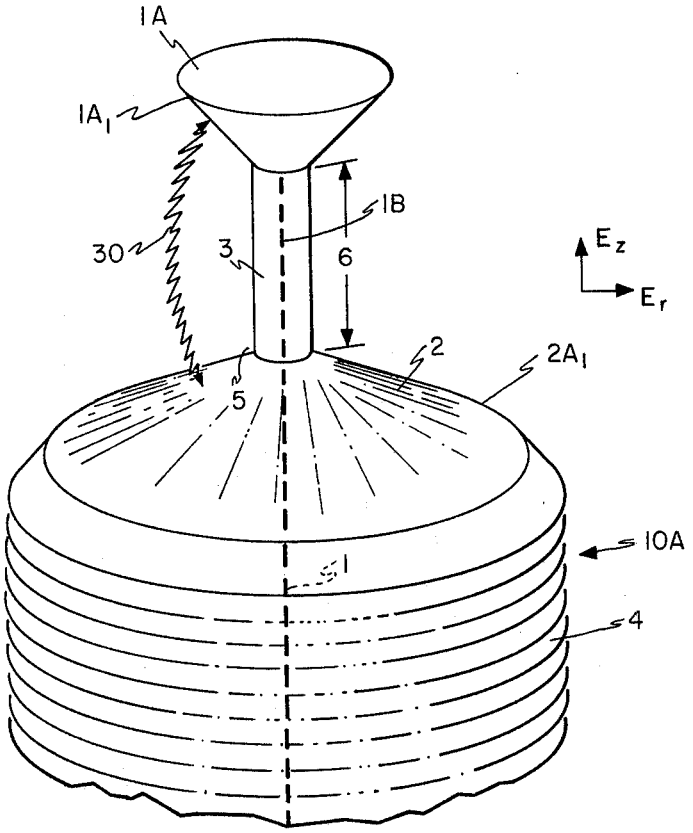
FIG. 5 is a partial isometric view of a further modification.

The electrode 1 in FIG. 5 is a high voltage elongate axial electrode which, as above noted, extends outward from the base or body 4 of the spark plug designated 10A. The outwardly extending part of the electrode 1 is covered by the thin (e.g., ~ 1 mm) insulating jacket 3 except for the exposed portion 1A at its free end. (Strictly speaking, the exposed portion 1A should be called the "electrode", but throughout this specification the high voltage electrode includes the electrical conductor between the input terminal 11 at the first end of the plug to and including the exposed portion 1A at the second end thereof.) The electrode 2 (which is a ground electrode in the embodiment shown and for the purposes of this discussion is assumed to be negative with respect to the electrode 1) is disposed adjacent the high voltage electrode 1 at a region 5 displaced from the exposed portion 1A by a substantial gap (see the gap numbered 6 in FIG. 5) and is separated therefrom at the region 5 by the insulating jacket 3 so that the distance from the ground electrode to the axial electrode through the jacket at the region 5 is much less than the distance from the ground electrode across the gap 6 to the exposed portion 1A (i.e., the distance between the sparking surfaces $1A_1$ and $2A_1$). Hence, in an operating system, corona discharge (which can in some cases be called pre-strike ionization) can be created between the high voltage electrode and the ground electrode; the corona begins in the high electric field region 5 wherein the two electrodes are closest together and spreads generally along the insulating jacket toward the sparking surface $1A_1$ due to an axial component of the electric field. When the corona discharge reaches the vicinity of the exposed portion 1A, an arc discharge 30 in FIG. 5 occurs through the corona between the sparking surface $1A_1$ of the first electrode 1 and the sparking surface $2A_1$ of the second or ground electrode 2 in the air space surrounding the insulating jacket, with a component of the arc being substantially parallel to the surface of said jacket: the arc 30 is a long arc compared to the 0.030 to 0.040 inch arc in more conventional spark plugs, being the order of 0.100 inches or more in length. The arc 30 follows a path whose shape and location are determined, in part, by the corona discharge and, therefore, by the shape and position of the active portions of the electrodes 1 and 2. The arc 30 will tend to occur in close proximity to the electrode 1, thereby tending to cause it initially to contact the surface of the insulator 3. In the plug 10A, the active portions of the electrodes 1 and 2 are shaped and positioned to provide a configuration wherein the initial surface discharge nature of the arc is affected by the electromagnetic interaction between the electric current in the arc and the electric current carried in the electrodes so that the arc will tend to lift from the insulator surface by virtue of said electromagnetic interaction. More specifically, an electric current, say, upward in the electrode 1 at the stem portion shown at 1B will interact electromagnetically with a current downward in the arc 30, causing the arc 30 to move radially outward away from the stem portion 1B of the electrode 1, but the present spark plug also affects the arc in another way, as now explained, again with reference to FIG. 5.

The sparking surface $1A_1$ of the electrode 1 is in the form of a frustum of a cone as is, also, the sparking surface $2A_1$ of the electrode 2. The axes of the cones coincide with the axis of the first electrode 1; the apexes of the two cones face each other; and the cone angles are chosen so that the electric lines of force entering or leaving the surfaces of the conical conductive sparking surfaces $1A_1$ and $2A_1$ are directed so that the electric discharge (i.e., the arc) of the energized spark plug 10A is forced radially outward from the plug axis; as now explained.

The action of the tapered sparking surfaces $1A_1$ and $2A_1$ can be understood from the boundary conditions on the electric field that drive the arc 30. This field cannot have a tangential component at each metallic, highly conductive sparking surface but must enter and leave each sparking surface normal thereto. Consequently, the lines of force acting on the charged species in the arc can be manipulated by proper orientation of the sparking surfaces $1A_1$ and $2A_1$ to force the arc outward from the plug axis. The electromagnetic force, as above stated, is directed normal to each sparking surface and is independent of the electric current magnitude in the arc, depending only on the potential difference between the sparking surfaces $1A_1$ and $2A_1$. Hence, by tapering the sparking surfaces in the way done here, the force on the arc, by virtue of that fact along, is directed outward strongly, thereby affecting the shape of the discharge even at low values of arc current.

To place matters in some perspective, the electric current through the electrode 1 and hence through the arc 30 initially may be the order of tens of amperes or more. This high current is determined in part by the circuitry external to the plug and some control of the high current pulses through the arc discharge can be attained by proper circuit design. In a capacitative discharge ignition system, without a current limiting series resistance, current pulses of both polarity have been observed with maximum current reaching approximately 60 amperes and lasting for $10^{-8}$ seconds. These pulses are reduced if a series resistance is included. High currents occur intermittently for approximately $10^{-4}$ seconds and then drops to a level of 50 milliamperes. The low electric current condition is the principal discharge phase of the spark plug and during the same the interaction force between the current in the arc 30 and the current in the axial high voltage electrode 1 has dropped sharply from the force present during the initial high current phase. The drop varies as the square of the ratio of the currents and, hence, can be a decrease in force by a factor of $4 \times 10^4$; however, the electromagnetic forces associated with the shape of the sparking surfaces $1A_1$ and $2A_1$ continues even at low electric currents to push the arc outward. And, initially, with several amperes flowing in the system, both aspects act together to provide the bowed out character of the arc 30 shown. A large amount of energy may be dissipated during the high current phase and this may be a vital part of the ignition process during which a substantial transfer of electrical energy could take place to the fuel air mixture. The outward movement of the arc 30 has a number of felicitous consequences; it removes the arc from contact with the surface of the insulator 3, thereby reducing fouling problems; it can be exploited to lengthen the arc, thereby increasing the ignition volume in the system; and it can create a continuously changing position of the arc which increases the ignition volume an even greater amount. In addition, the arc thereby formed is a new type discharge. It is known that the scattering cross section as described by the Born approximation decreases as the square of the velocity of the impinging particle. Thus, the probability of initiating a chemical reaction associated with the combustion forces will decrease if the velocities of the charged species in the arc become too high. The new type discharge herein gives rise to a wide distribution of energies, thereby enhancing the likelihood of correctly matching the energy of at least part of the discharge to the chemical process to which it is to couple. Furthermore, in view of the fact that the present invention adds two further controllable parameters, the control of the arc can be very precisely variable. In other words, in view of recent developments in analysis capability and in view of the advent of microprocessors and the like (see United States Letters Patent No. 3,897,766, Pratt, Jr.), the arc path and the energy therein can be controlled by an appropriate electric power source to optimize those conditions of optimization. Furthermore, as mentioned above, after ignition has been started, a large volume of the burning fuel is subjected to a high electric field. Electric energy is coupled into the burning gases, affecting the nature of flame propagation.

Turning again to FIG. 1, the spark plug 10 has at least one floating electrode 7 which has sparking surfaces 7A and 7B. The corona discharge is initiated at the region 5, as before, and proceeds upward toward the sparking surface $1A_1$ in FIG. 1; an arc 30A forms between the surface $2A_1$ and the surface 7A. The floating electrode 7 is capacitively coupled through the thin insulating sleeve 3 to the stem portion 1B of the electrode 1 so that for some short delay time while this capacitance charges, only the arc 30A is present; after said short time delay, an arc 30B strikes between the tapered sparking surface 7B and the tapered sparking surface $1A_1$. It has been found, for present purposes, that the intermediate electrode 7 permits a larger total gap than otherwise allowable at the high pressures in internal combustion engines with the above-mentioned beneficial results. By way of illustration, a total gap of 0.225 inches can successfully be used in a standard ignition system with a floating electrode to divide the gap.

The gap 6 in FIG. 5 consists of two serial gaps in the plug 10 of FIG. 1, one gap between the tapered sparking surface $2A_1$ and the tapered sparking surface 7A and the other between the tapered sparking surface 7B and the tapered sparking $1A_1$. In each instance, the gap increases in length at increasing radial distances outward from the jacket 3. The electrode 7 is a band or a ring that encircles the jacket 3 so that an arc can form at any circumferential part thereof.

Mention is made previously herein that the path of the arc is determined, in part, by the shape of the sparking surfaces $1A_1$ and $2A_1$ in the plug 10A of FIG. 5; similarly the path of arc 30B between the floating electrode 7 and the electrode 1 of FIG. 1 is determined, in part, by the shape of the sparking surfaces. In addition, it has been observed that an arc can form directly between the sparking surfaces $1A_1$ and $2A_1$ in the spark plug 10 of FIG. 1. Also, it has been observed that appropriate orientation of the floating electrode 7 can result in an arc 30A on one side of the jacket 3 of the plug 10 and an arc 30B on the other side thereof. This situation will effect ignition of the fuel air mixture at substantially different sites about the jacket. It has been further observed by microscopic examination of the electrode surfaces of spark plugs, like the spark plugs 10 and 10A, after the spark plugs have been used in a combustion engine, that arcing tends to occur around the entire annular sparking surfaces. It is also evident that arcing occurs out to the extreme periphery of the sparking surfaces. In connection with the present work, sparking surfaces made of superalloys such as Udimet 500 have proved to be very durable for the sparking surfaces $1A_1$ and $2A_1$ and the floating electrode 7. In general, it is necessary to use metals capable of withstanding high temperatures and resistant to pitting in view of the several electric and electrochemical forces present.

Figure 4:
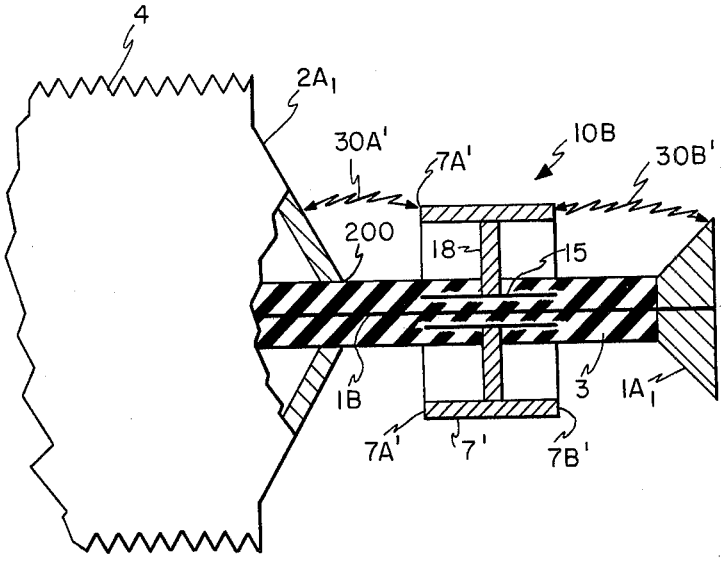
FIG. 4 is a partial side view, partly cutaway, showing a modification of the spark plug of FIG. 1.

The spark plug labeled 10B in FIG. 4 has many of the same elements as the plug 10, but the intermediate or floating electrode labeled 7' in FIG. 4 differs in shape from the electrode 7. The floating electrode 7', like the electrode 7, is preferentially in the form of a band or ring that encircles (i.e., is disposed about) the jacket 3, but the sparking surfaces labeled 7A' and 7B' are disposed radially outward a substantial distance by a supporting structure 18 so that the arcs shown at 30A' and 30B' form away from the jacket 3. Again the arcs thus formed are pushed outward by interaction between electric currents in the two arcs and electric current in the stem portion 1B of the axial electrode 1. A capacitor plate 15, embedded in the insulation jacket 3, is capactively coupled to the stem portion 1B through the insulation.

Figure 8:
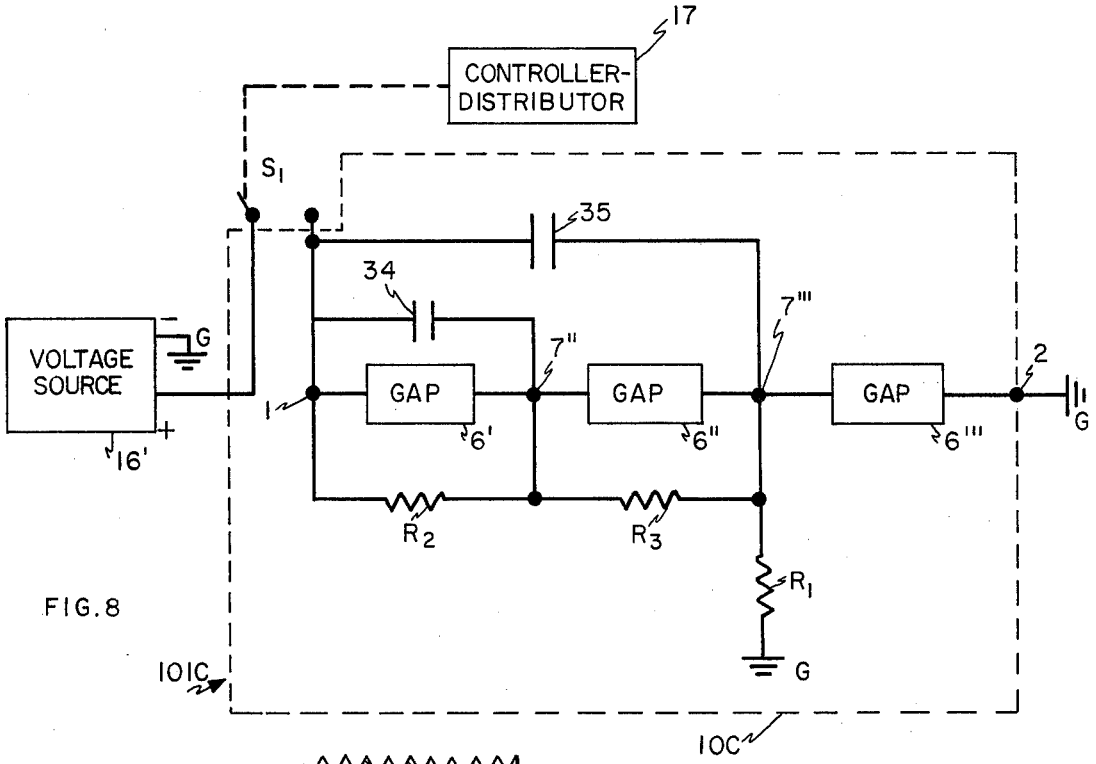
FIG. 8 is a schematic of a spark plug with main electrodes and a plurality of floating electrodes in a further circuit arrangement.

The capacitive coupling of the floating or intermediate electrodes is shown schematically in FIG. 8 which shows a spark plug 10C having a plurality of such floating electrodes 7'' and 7''' (or more) coupled through capacitors 34 and 35 to the high voltage electrode 1. Shunting resistors $R_1$, $R_2$ and $R_3$ ($\sim$ one megohm) represent the surface resistance among the several electrodes. The spark gap between the main electrode 1 and the floating electrode 7'' is marked 6', the gap between floating electrodes 7'' and 7''' is marked 6'' and the gap between the floating electrode 7''' and the main electrode 2 is marked 6'''. The system labeled 101C in FIG. 8 employs the multiple gap spark plug 10C which has provision (not shown in FIG. 8) for corona discharge as before, as well as a voltage source 16', which is connected through a switch $S_1$ to energize the plug 10C. The switch $S_1$ is under the control of a controller-distributor 17.

A few further matters of a general nature are included in this paragraph. It has been found to be advantageous if the sparking surface $1A_1$ is so shaped that it has an exposed rim at the location labeled 23 in FIGS. 1 and 2, by, for example, making the cap 1A slightly larger than the jacket 3 where the two are in contact. This rim provides a field intensification which aids in establishing the arc discharge at a lower voltage than otherwise possible. The surface of the insulating jacket was found in experimental work done to remain extremely clean with the incorporation of this field intensification surface into the sparking surface $1A_1$. A similar field intensification portion is found in sparking surfaces $2A_1$ shown as 200 in FIG. 4. The thermal mass of the sparking surfaces $1A_1$ and $2A_1$, and to some extent those associated with the floating electrodes, will act to cool the burning gases. Furthermore, the effect of the electric field on the burning gas will tend to drive the flame onto one or another of the sparking surfaces. Thus a partial electromagnetic induced confinement of the flame is achieved. Consequently some heat sinking or cooling of the flame will take place as a result of flame interaction with the electrode. This will act to suppress $NO_x$ formation. It is important, therefore, to select the heat transfer characteristics of the sparking surfaces, the electrodes, and the plug body and to control the voltage applied to the plug so that total quenching of the flame does not occur but a desired and controlled degree of cooling does take place so as to reduce the production of $NO_x$. Because of the very different nature of the multiple arcs associated with this spark plug and its effect on the burning mixture, it is essential that proper timing of the spark be carried out.

The insulating jacket 3 can be made of conventional ceramic insulating material used in spark plugs. The foregoing electromagnetic interaction can be enhanced, however, by distributing through the insulating material prior to formation a small amount of $Fe_3O_4$ or some other magnetic particulate (e.g., the jacket 3 can be a ferrite). The particulate will increase the magnetic field due to current in the electrode 1 without degrading the insulating properties of the jacket 3. Small magnetic particles in the 100 to 1000A range of sizes could act effectively in this regard.

As above noted, corona is believed to begin in the region 5 and move along the insulating jacket; as it does, it is subjected to electric lines of force between the ground electrode 2 and the exposed portion 1A of the high voltage electrode 1 in an operating system 101 in FIG. 2 to provide an arc. The arc thus formed moves along a path generally parallel to the stem portion 1B of the axial electrode 1 which is covered by the insulating jacket. The path of the arc is, then, determined in part by the corona, and the shape of the corona is determined to a large extent by the geometry of the electrode 1. Hence, the jacketed high voltage electrode serves to guide the corona and, thus, the arc discharge. It is also possible to guide the corona along curved insulating surfaces covering a curved high voltage electrode.

The spark plug 10 has a conventional base 4 that threads into an engine block at electrical ground, as above noted. In FIG. 2, as above indicated, the elements 21 and 22 represent a cylinder and piston, respectively, of such engine. The region marked 20 can represent a confined elongate volume bounded in part by engine walls which can serve to cool the initial combustion.

The spark plug disclosed herein can also be used in rotary engines and, in general, in combustion systems that require spark ignition devices. The high voltage supply means can be a capacitance discharge system or conventional automobile coil, or such means can be a supply that furnishes a waveform to provide timing in connection with both the corona discharge and the arc discharge. Further, in the immediate vicinity of the spark plug 10 there will be an air-fuel mixture, and, in this connection, the duration of the corona discharge can effect the composition of said mixture. Also, since the amount of electrical energy that can be dissipated in the arc is a function of the arc length, the present system introduces great benefits to any combustion system, particularly in lean burning engines having a high air-to-fuel ratio. And, it can now be seen, such energy can be increased as the arc is moved outward since, as distinguished from prior-art systems, in the present system the arc length is or can be increased. In what follows, some theories underlying the present invention are given more rigorous treatment than is done in the foregoing explanation.

Work done to date indicates that a corona is first established between the ground electrode 2 and the high voltage electrode 1 through the insulator 3. The charged species in the corona experience an electric field having a radial component $E_r$ in FIG. 5 directed perpendicular to the axially directed high voltage electrode 1, and an axial component $E_z$ directed parallel to electrode 1. The radial and axial currents $J_r$ and $J_z$, respectively are $$J_r = \delta_r E_r$$

$$J_z = \delta_z E_z$$

where $\delta_r$ is the radial conductivity through the insulating jacket 3 to the electrode 1 and $\delta_z$ is the conductivity along the surface of the jacket 3.

Although $E_r >> E_z$, because of the insulating jacket, $\delta_z >> \delta_r$. An arc can be established in the axial direction yielding $J_z >> J_r$. The current in the arc 30 in FIG. 5 is essentially equal in magnitude and opposite in direction to the current flowing in the insulated high voltage electrode at 1B. These two currents exert a force on each other in the radial direction forcing them apart. Since the arc can move in space, it will lift off the surface of the insulating jacket 3, as previously mentioned. The radially directed force F per unit length $l$ acting on the arc is $$\frac{F}{l} = \frac{2 \times 10^{-7}}{a} (I_{arc})^2$$

where F is in newtons, $l$ and $a$ are in meters, and $I_{arc}$ in amperes. The separation between the arc current and that carried by electrode 1 is given by $a$. The current $I_{arc}$ is not constant when the arc discharge occurs. Immediately after the arc is established, $I_{arc}$ can be quite large while the self-capacitance of the plug is discharged. Values as high as 10 amperes (using noise-suppressing components) can be attained over a time scale of $10^{-8}$ seconds. This high current quickly drops to a value of approximately 50 mA during the dissipation of the magnetic energy in the coil of a conventional ignition system. The self-capacitance of the plug can be deliberately controlled to affect the value of $I_{arc}$. The duration of the self-capacitance discharge can be adjusted by manipulation of the RC time constant of said discharge. If, for example, $I_{arc}$ is taken to be ten amperes and the arc 30 has pushed away from the axial electrode 1 to a distance $a$ of 0.1 then $$\frac{F}{l} = \frac{2 \times 10^{-7} \times 10^2}{1 \times 10^{-3}} = 2.0 \times 10^{-2} \frac{\text{newtons}}{\text{meter}}$$

The force acting on an individual electron or positive ion in the arc would be the order of $$2.0 \times 10^{-2} \times 10^{-10} = 2.0 \times 10^{-2} \text{ newtons}$$

This is to be compared with the force $F_1$ on the electron or positive ion due to the electric field that drives the arc. If the field in the gap 6 in FIG. 5 is 30,000 V/cm, the corresponding driving force $F_1$ is $$F_1 = 1.6 \times 10^{-19} \times 3 \times 10^6 = 4.8 \times 10^{-13} \text{ newtons}$$

Hence, the force F acting to push the arc away from the surface of the insulator 3 can dominate the electric force $F_1$ that produces the arc itself during high current pulsations. This tendency to lift the arc off the surface is important because it can be used to establish the arc away from a surface that could otherwise quench the combustion process, it allows better propagation of the combustion process in all directions away from one arc, and it reduces plug fouling since a surface current is strongly pushed off the surface. The tendency to push the arc away from the surface is of further importance as it can be used to control the length of the arc. The lifting action can be very effectively assisted by shaping the sparking surfaces $1A_1$ and $2A_1$, and those associated with intermediate or floating electrodes, in the manner previously described, by providing a sparking surface having a substantial area whose outward normal is directed so that it can initiate or terminate an arc which is forced outward and away from an electrode of the plug that carries all or part of the plug current. In FIG. 5 the outward direction is radial and the axial electrode 1 carries substantially all the plug current.

As pointed out above, the electric current carried by electrode 1 and, therefore, the arc current, is determined by nature of the ignition circuit and by the nature of the discharge. In a capacitive ignition system, it was found that within the first 500 microseconds large current oscillations took place with peak amplitudes as high as 50 amperes. Over a period of 140 microseconds, large current and, in work done in connection with the present invention, voltage transients of both polarities were observed. These transients were much more pronounced in the floating electrode plug disclosed herein as compared to the conventional spark plug (Champion NY-13) and more pronounced that those observed in a plug having the same structure as that presently disclosed and shown in FIG. 1 and FIG. 2 but with no floating electrode 7. The very large current and voltage transients which take place during the first $500 \times 10^{-9}$ seconds will transfer a substantial amount of energy into the fuel-air mixture whose flame front travelling at 800 cm/second could only move some four microns during this time interval. Therefore, intense local heating can be expected over this period. This will produce a local plasma into which energy can be transferred from the electric field applied to the plug electrodes. This plasma will be further enhanced by the combustion reaction itself.

The use of low work function material in the electrodes (in the sparking surfaces, for example) and in the insulating jacket 3 of FIG. 1 can also be of use in facilitating the establishment of the corona discharge and the arc itself. Materials such as $LaB_6$, for example, have very low work functions and produce a copious supply of electrons as a result of elevated temperatures and electric fields. These electrons emanate from a combination of thermionic and field emissions. Electrons liberated in the high field produce and assist in the production of the corona and arc discharges. These discharges are initiated and maintained at higher pressures and lower voltages if the supply of electrons in the gas is enhanced. This is in part due to the ability of electrons accelerated by the electric fields present from the high voltage source to produce ionization in the gas. Of course, the insulating quality of the jacket 3 must be maintained so that breakdown through it does not occur.

Figure 3:
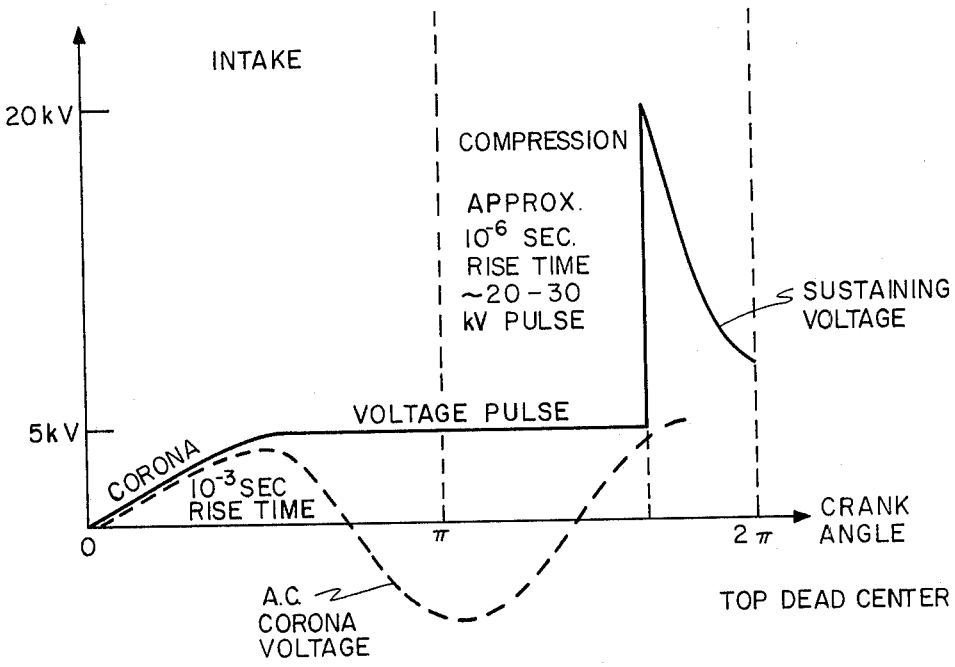
FIG. 3 shows a voltage curve of an electric potential that may be applied to the spark pug of FIG 1.

The high voltage source that creates the initial corona discharge and establishes the arc can be adapted to perform several functions. It can supply a corona voltage and limit the corona current so as to suppress the formation of an arc until the desired instant. A fast rise time pulse as shown in FIG. 3 can be impressed upon the corona voltage, which might be in the 5kv range, to create the arc. Multiple fast rise time arc-forming pulses could be supplied to form a sequence of arc discharges. Further, this sequence of arcs can be used in the ignition of a single fuel-air charge. The corona can be created simply as a consequence of the voltage increase associated with the voltage pulse that establishes the arc discharge. The corona stage of the discharge may last only for a very short time. Some technical matters relating to the arc and an electric system to effect the various electrical functions herein disclosed are now taken up.

The interaction between the current carried in the arc and the current flowing in the insulated high voltage electrode can be used to control the length of the arc, as is previously noted herein. One means of effecting this control is to vary the current carried by the arc. This can be done by using a variable current or voltage source connected across the plug terminals. When the arc discharge is off, the resistance $R_{off}$ of the plug is high, e.g., $10^6$ ohms. During the corona discharge preceeding the arc, the resistance $R_{corona}$ is also quite high and the corona current is in the $10^{-5}$ ampere range. When the arc is on, the resistance across the plug $R_{on}$ is drastically decreased from $R_{off}$. $R_{on}$ will usually be of the order of 10 ohms. A variable voltage or current source can now be used to pass a control current through the arc and consequently affect the force which tends physically to separate the arc from the currents flowing in the plug structure; and by using tapered sparking surfaces of the type shown herein, the length of the arc is further affected. An electric circuit using a control scheme is shown in FIG. 6 for a standard ignition system.

Figure 6:
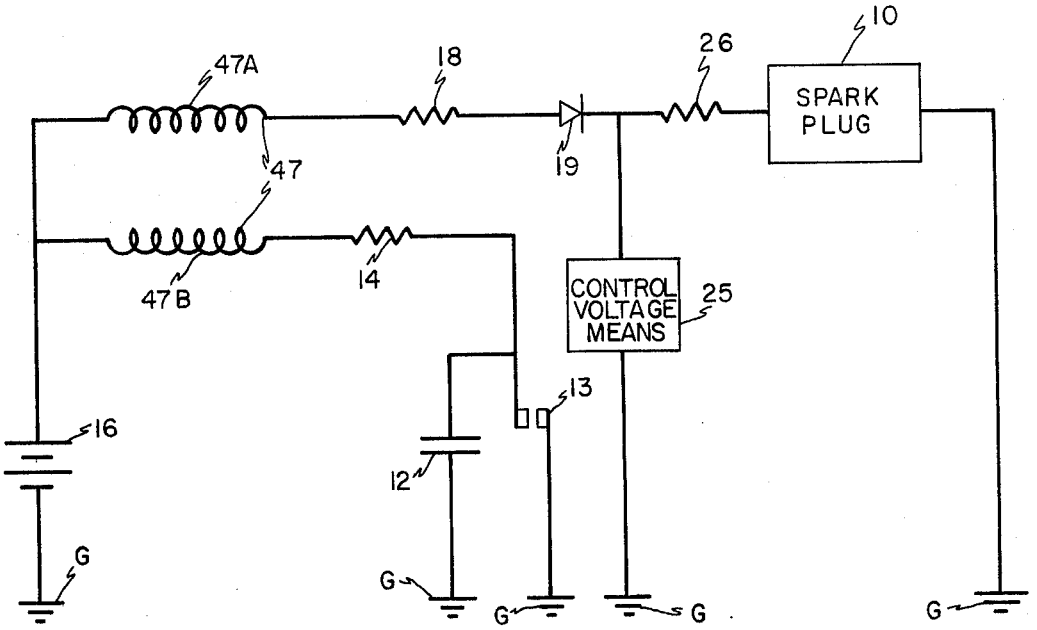
FIG. 6 is a schematic electric circuit diagram of a system that includes a spark plug like that shown in FIG. 1 plus a power supply to energize the spark plug and a control voltage means to manipulate the arc.

The electric circuit of FIG. 6 includes a battery 16 and a coil 47. The coil 47 has two windings, 47A and 47B, as in a conventional system, one of which, 47A, is connected through a resistance 18 and diode 19 to the single spark plug 10 in FIG. 7. The winding 47B is connected through a resistance 14 to points 13 and a parallel condenser 12. Control voltage means 25 serves to control the voltage rise time, the value and duration of the arc current, and the voltage applied after ignition has been initiated.

Figure 7:
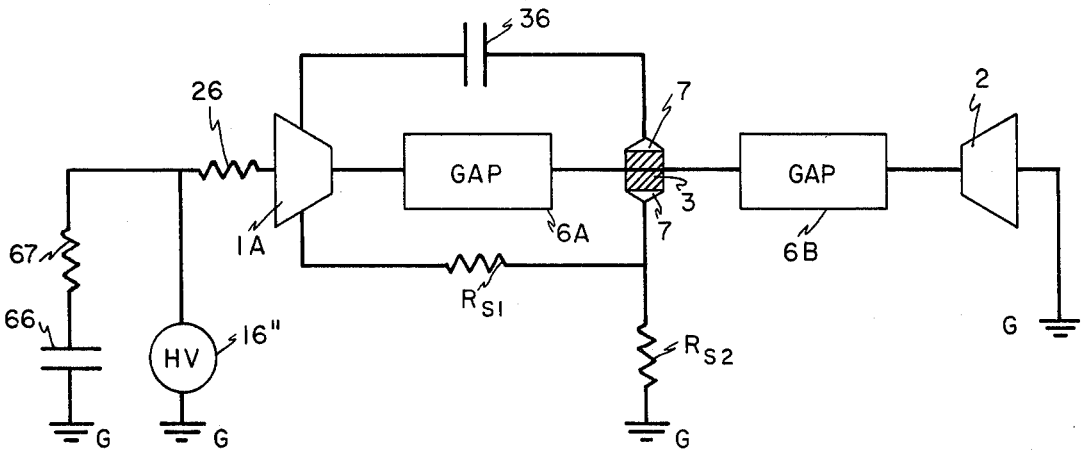
FIG. 7 is a schematic circuit diagram showing a further circuit arrangement to energize the spark plug herein disclosed.

FIG. 7 is an equivalent circuit representation of the plug structure shown in FIG. 1. The floating or intermediate electrode 7 is coupled by an RC network to the high voltage electrode 1 through the insulating jacket 3 and this is explicitly represented in FIG. 7 by the capacitor labeled 36 and resistor $R_{S1}$ which represents the resistance between the high voltage electrode at 1A along the insulator surface to the floating electrode 7. The resistance from the floating electrode 7 to ground is marked $R_{S2}$. The arc 30B of FIG. 1 is formed in the gap shown at 6A in FIG. 7 while the arc 30A of FIG. 1 is formed in the gap shown at 6B in FIG. 7. An additional capacitor 66 can be connected across the plug or equivalently across the high voltage source marked 16'' to increase the effective self-capacitance of the plug. A resistor 67 connected in series with the capacitor 66 controls the RC time constant of the discharge of the capacitor which occurs when the gaps 6A and 6B are broken down so that the overall impedance between the electrodes 1 and 2 drops to a low value as a result of the arc discharge. The energy stored in the capacitor 66 is released into the arc so that the arc current can be controlled in both amplitude and time by variation of the capacitance and resistance, in particular of elements 66 and 67 of FIG. 7, in the high voltage source to the plug controls the arc current. This could be done by a computer using feedback signals from a variety of sensing elements, such as, for example, torque and rpm sensors, to optimize performance. During the cold start conditions and in circumstances where fouling is aggravated, additional arc current would be helpful in insuring ignition. Several modes of behavior of the circuit of FIG. 7 are possible, depending upon the nature of the signal from the high voltage source 16'' and the circuit elements of the plug structure. If the capacitor 36 is large enough and the voltage rise time fast enough, then the capacitor 36 will act as a high pass filter and most of the high voltage will appear across gap 6B. When the gap 6B breaks down, substantially all of the high voltage will occur across gap 6A, causing it to break down. If the capacitance 36 is negligible, the resistors $R_{S1}$ which is in parallel with the resistance of gap 6A would act with the resistance $R_{S2}$ which is in parallel with gap 6B to divide the voltage drop between the electrodes 1 and 2. It is apparent that a fast rise time of the high voltage signal is very desirable so that the maximum possible voltage appears across the gaps during this sequential breakdown.

Figure 9:
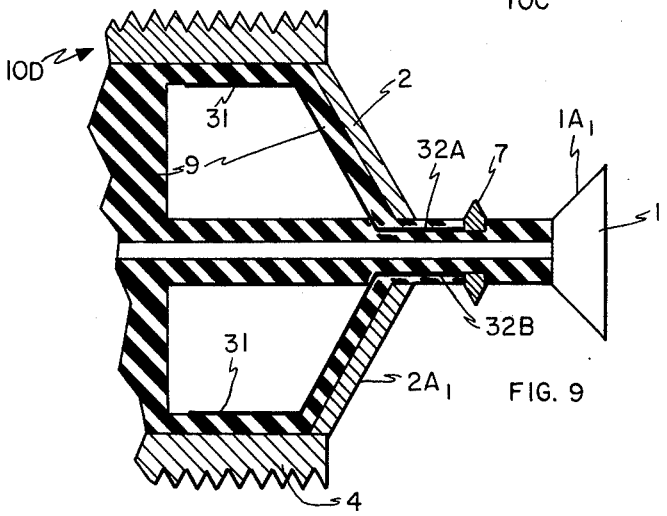
FIG. 9 is a partial side section view of a modification of the spark plug of FIG. 1.

The floating electrode 7 can be capacitively coupled by an RC network to ground, that is, it can be coupled to the plug body, as shown in FIG. 9 wherein the spark plug is designated 10D, rather than to the high voltage electrode 1. That would be equivalent to connecting the capacitor 36 in FIG. 7 to ground rather than to the high voltage source. This change is effected in FIG. 9 by connecting the floating electrode 7 to a cylindrical capacitor plate 31 coaxial with the plug base 4 by conductive support strips 32A and 32B; the cylindrical capacitor plate 31 is separated from the base 4 by the insulator 9. This arrangement will also serve to heat sink the floating electrode 7 as well as providing mechanical support therefor. The incoming voltage pulse from a voltage source to the plug 100 would see the floating electrode 7 effectively at ground if the voltage rise time were fast compared to the RC time constant of the self-capacitance and self-resistance of the plug 10D. This would cause a gap between the electrodes 2 and 7 of the plug 10D to breakdown first, followed by the sequential breakdown of gap between the electrodes 7 and 1 of the plug 10D. A multiple floating electrode structure would also be possible if the floating electrodes 7″ and 7‴ shown in FIG. 8 were coupled by RC networks to ground or to one of the high voltage electrode and the other to ground or with only one of them coupled by a combination of impedances to either the high voltage electrode or to ground. A different circuit representation would be required for each of these cases. The basic concept taught here is a structure employing intermediate or floating electrodes however coupled to their electrical environment so that an arc will form using the shape, orientation and position of the floating electrodes to establish a long overall arc whose current is directed opposite to the discharge current in at least a portion of the plug structure, resulting in an electromagnetic repulsion force on at least part of the arc and acting to force a portion of the arc away from the surface of the insulator which spaces the floating electrodes, the several electrode sparking surfaces being so shaped that the field lines normal to these surfaces act to assist in the formation of the arc along one or more paths not contacting the insulator surface.

The spark plug herein disclosed is particularly useful in a combustion engine system which includes a computer capable of rapid control of the engine operating parameters such as a fuel-air ratio, spark timing, and the like, and further adapted to control the nature of the arc discharge of each spark plug by manipulating the output of a variable voltage or current source connected to the plug. The individual firings of each plug could be controlled not only as to the timing of the discharge but its physical nature as well, e.g., amount of corona, length of the arc discharge and duration of the arc discharge (see in this connection, United States Letters Patent No. 3,897,766, Pratt, Jr.). Furthermore, the voltage supplied to a plug after combustion has begun could be controlled so as to affect the electromagnetic interaction between the plug structure and the ionization in the burning fuel-air mixture for the purpose of controlling the nature of the combustion process and the rate of combustion.

Spaces in the plug structure such as that beneath the sparking surface $2A_1$ in FIG. 1, which can trap fuel which does not burn may be filled.

Further modifications of the invention herein disclosed will occur to persons skilled in the art and all such modifications are deemed to be within the spirit and scope of the invention as defined by the appended claims.

What is claimed is:

1. A spark plug that comprises, in combination, a first electrode covered with insulation except for a first exposed portion to which electrical contact is made to an ignition system and for a second exposed portion which has a first sparking surface, said first sparking surface acting to initiate or terminate one end of the electric discharge associated with the energized plug, a plug body which serves as grounding means and which is connected to a second sparking surface, said plug body being concentric with said first electrode, said second sparking surface serving to initiate or terminate another end of said electric discharge, said first sparking surface and said second sparking surface being generally conical in shape, the axes of the cones coinciding with the axis of said first electrode, the apex of the two cones facing each other along the plug axis, the cone angles being chosen so that the lines of electrical force entering or leaving said conical sparking surfaces are directed so that the electric discharge of the energized plug is forced radially outward from the plug axis away from the surface of said insulation, at least one floating electrode having a pair of associated sparking surfaces disposed about said insulation and located between the first and second sparking surfaces, there being a spark gap between one of said associated sparking surfaces and the second sparking surface and a further spark gap between the other of said associated sparking surfaces and the first sparking surface, said associated sparking surfaces acting to terminate and initiate a portion of the electric discharge passing between said first sparking surface and said second sparking surface, the first sparking surface, the second sparking surface and the associated sparking surfaces being so shaped, positioned and oriented that current flowing in an arc between any two sparking surfaces in an operating spark plug interacts electromagnetically with current carried by the first electrode to force the arc away from said insulation.

2. A spark plug as claimed in claim 1 in which the second exposed portion of said first electrode is shaped, positioned, and oriented, and of sufficient thermal mass and with requisite thermal interconnection to the remainder of said spark plug so that it acts as a heat sink to cool the initial phase of combustion, thereby to suppress the production of undesirable combustion products.

3. A spark plug as claimed in claim 1 in which the sparking surfaces are disposed so that the initial combustion tends to be confined to a volume in which the flame temperature can be controlled by presence of heat sinking surfaces forming at least part of the boundary of said volume.

4. A spark plug as claimed in claim 1 in which the sparking surfaces of said floating electrode are shaped, positioned, and oriented so that the lines of force acting upon the electric discharge of the energized spark plug act to force said discharge away from said insulation.

5. A spark plug as claimed in claim 1 in which the at least one floating electrode is resistively-capacitively coupled to said first electrode.

6. A spark plug as claimed in claim 1 in which the at least one floating electrode is resistively-capacitively coupled to the plug body.

7. A spark plug as claimed in claim 1 in which the at least one floating electrode is resistively-capacitively coupled to said first electrode and which includes a further floating electrode that is resistively-capacitively coupled to the plug body.

8. An elongate spark plug that comprises, in combination, a conductive body, a first electrode electrically isolated from the spark plug body, said first electrode extending outward from the body of the spark plug at one axial end of the plug and extending as well to effect electrical connection to a terminal at the other axial end of the spark plug, the first electrode being surrounded by solid insulation from the terminal to an exposed portion at said one end, a second electrode connected to and extending from the body of the spark plug to a region of the first electrode that is surrounded by the solid insulation, the second electrode being separated from the first electrode by a distance through the solid insulation that is much less than the gap that exists between the second electrode and said exposed portion of the first electrode, and at least one intermediate floating electrode within said gap.

9. A spark plug as claimed in claim 8 in which the exposed portion of the first electrode is tapered and in which the second electrode has a tapered sparking surface so that an arc formed in an operating spark plug can be controlled in length between two tapered sparking surfaces.

10. A spark plug as claimed in claim 8 in which the first electrode has sufficient thermal massive and is thermally interconnected to the remainder of the spark plug to serve as a heat sink to cool the initial phase of combustion, thereby to suppress the production of $NO_x$ during combustion.

11. In a combustion engine, a spark plug as claimed in claim 8 wherein the spark plug is disposed within the engine wall to define a confined elongate volume that is coaxial with the spark plug axis, so that initial combustion occurs within said elongate volume and the walls of the engine forming said volume act to cool the initial combustion to reduce $NO_x$, the spark length between the first electrode and the second electrode being sufficiently long to effect combustion despite the quenching effects of the cooling surfaces.

12. A spark plug as claimed in claim 8 in which said distance is much less than the gap that exists between the second electrode and the floating electrode, the floating electrode being capacitively coupled with one of the first electrode and the second electrode.

13. A spark plug as claimed in claim 12 wherein the first and second electrodes have sparking surfaces shaped, positioned and oriented in such a way that electric lines of force entering or leaving the surfaces act to force any electric discharge away from said solid insulation.

14. A spark plug as claimed in claim 13 in which the first electrode and the second electrode are so positioned that the electric current in an arc in the spark gap between the sparking surfaces interacts with the electric current in one of the first electrode and the second electrode to force the arc away from the solid insulation.

15. A spark plug as claimed in claim 8 comprising a plurality of intermediate electrodes at least one of which is resistively-capacitively coupled to said first electrode.

16. A spark plug as claimed in claim 8 comprising a plurality of intermediate electrodes at least one of which is resistively-capacitively coupled to said second electrode.

17. A spark plug as claimed in claim 8 having means for coupling the intermediate electrode to the second electrode which includes means for mechanical support of said intermediate electrode.

18. A spark plug as claimed in claim 8 in which said at least one intermediate electrode is resistively-capacitively coupled to the first electrode and to the second electrode.

19. A spark plug as claimed in claim 8 in which there is a plurality of intermediate electrodes resistively-capacitively coupled to each other, to the first electrode and to the second electrode.

20. A spark plug as claimed in claim 8 in which at least one of said sparking surfaces is made of a high temperature alloy.

21. A spark plug as claimed in claim 8 adapted effectively to control the propagation of the flame front and to extract heat from the flame by virtue of the electrical force exerted upon charged species that occur in the course of the combustion process.

22. A spark plug as claimed in claim 8 in which at least a portion of said insulation contains magnetic particulate which acts to enhance the electromagnetic force of repulsion between at least a portion of an arc formed in an operating spark plug and at least one of the spark plug electrodes.

23. A spark plug as claimed in claim 8 in which said at least one of said floating electrodes is oriented so that arc discharges are formed which either initiate or terminate on substantially different sites on said oriented floating electrode.

24. A spark plug as claimed in claim 8 in which at least one of the electrodes is so shaped that at least a part of its surface acts to provide a field intensification which assists in the establishment of an arc discharge.

25. A spark plug as claimed in claim 8 in which low work function material is used in at least one of the insulation and electrodes.

26. A spark plug as claimed in claim 8 in which a sparking surface of at least one intermediate electrode is disposed outward a substantial distance from the said insulation.

27. In a combustion engine, a spark plug as claimed in claim 8 having the property that the length and disposition of an arc discharge of the energized spark plug can be electronically controlled, and further comprising means for supplying voltage to said spark plug after combustion has begun so as to affect the nature of the combustion process.

* * * * *